US006528929B1

(12) United States Patent
Matsutani et al.

(10) Patent No.: US 6,528,929 B1
(45) Date of Patent: Mar. 4, 2003

(54) SPARK PLUG WITH IRIDIUM-BASED ALLOY CHIP

(75) Inventors: Wataru Matsutani, Aichi (JP); Hiroaki Nasu, Aichi (JP)

(73) Assignee: NGK Spark Plug Co., Ltd. (JP)

( * ) Notice: Subject to any disclaimer, the term of this patent is extended or adjusted under 35 U.S.C. 154(b) by 0 days.

(21) Appl. No.: 09/437,359

(22) Filed: Nov. 10, 1999

(30) Foreign Application Priority Data

Nov. 11, 1998 (JP) ..... 10-320376

(51) Int. Cl.[7] ..... H01T 13/39
(52) U.S. Cl. ..... 313/141; 313/142
(58) Field of Search ..... 313/141, 142

(56) References Cited

U.S. PATENT DOCUMENTS 5,440,198 A * 8/1995 Oshima et al. ..... 313/141
5,877,584 A * 3/1999 Kato et al. ..... 313/141
5,990,602 A * 11/1999 Katoh et al. ..... 313/141

FOREIGN PATENT DOCUMENTS

| | | | | |
|---|---|---|---|---|
| EP | 0936710 A1 | | 8/1999 | ..... H01T/13/39 |
| JP | Hei-5-13143 | | 1/1993 | ..... H01T/13/39 |
| JP | Hei-5-67488 | | 3/1993 | ..... H01T/13/39 |
| JP | 5-335066 | * | 12/1993 | ..... H01T/13/20 |
| JP | Hei-8-339880 | | 12/1996 | ..... H01T/13/39 |
| JP | Hei-9-7733 | | 1/1997 | ..... H01T/13/39 |
| JP | Hei-9-129357 | | 5/1997 | ..... H01T/13/20 |
| JP | Hei-9-219274 | | 8/1997 | ..... H01T/13/20 |

* cited by examiner

*Primary Examiner*—Michael H. Day
(74) *Attorney, Agent, or Firm*—Brinks Hofer Gilson & Lione

(57) ABSTRACT

A spark plug includes a chip made of iridium. The distance E between the chip and a copper core of a core rod of the center electrode is not greater than 3.5 mm. The core rod has a diameter D1 of 1.4 mm to 2.6 mm. The ratio of a chip diameter D2 to the core rod diameter D1, or D2/D1, is not greater than 0.50.

4 Claims, 9 Drawing Sheets

SPARK PLUG WITH IRIDIUM-BASED ALLOY CHIP

BACKGROUND OF THE INVENTION

1. Field of the Invention

The present invention relates to a spark plug used as an ignition device for an internal combustion engine. More particularly, the invention relates to a spark plug that employs a chip or member resistant to spark consumption, made of an iridium-based alloy having a high melting point.

2. Description of the Related Art

Conventionally, the electrode of a standard spark plug has been made of a nickel-based alloy having corrosion resistance and a high melting point, specifically, an alloy containing Ni in an amount of 90% or more. In a spark plug required to exhibit high performance and long life, its spark portion is formed such that iconel is used as a base material and a noble metal chip having a melting point higher than that of inconel is welded to the base material. A noble metal chip of platinum or platinum-based alloy has been of practical use. A spark plug having such a noble metal chip is called a platinum spark plug.

Recently, with growing demand for higher performance (improved igniting performance) and longer life (improved resistance to spark consumption), studies have been carried out on a spark plug that employs a chip made of an alloy of iridium, which has a melting point higher than that of platinum.

Meanwhile, increases in engine output and increasing use of spark plugs in direct-injection engines involve a significant increase in thermal load exerted on the chip of a spark plug. Since iridium oxide shows volatility at high temperature, in some cases, even a chip of a highly durable iridium alloy has exhibited drastic, unusual consumption or biased consumption, conceivably due to increased chip temperature. Also, a core rod made of inconel and carrying the chip is heated excessively and a resultant thermal deformation thereof has occasionally caused cracking in an insulator.

The present inventors have carried out various experiments and have found that when dimensional restrictions are imposed on a chip made of an iridium alloy and a core rod made of inconel and supporting the chip, unusual consumption or biased consumption of the chip can be avoided and excessive heating of the core rod can be prevented.

SUMMARY OF THE INVENTION

In view of the foregoing, an object of the present invention is to provide a spark plug employing a chip of iridium and capable of avoiding unusual consumption or biased consumption of the chip and suppressing excessive heating of a core rod.

To achieve the above object, the present invention provides a spark plug comprising an insulator having a center through-hole formed therein; a center electrode held in the center through-hole; a metallic shell for holding the insulator; and a ground electrode electrically connected to the metallic shell. The center electrode comprises a core rod and a chip. The core rod is made of a nickel-based alloy and includes a copper core embedded therein. The chip is formed of a member resistant to spark consumption and fixed to a tip end of the core rod in order to form a spark discharge gap in cooperation with the ground electrode. The chip is made of an iridium-based alloy which contains one or more elements selected from among platinum, rhodium, rhenium, and palladium. In this specification the term "alloy" means alloy which is formed through melting of its base metal and additional metal elements. The distance between the chip and a tip end of the copper core is not greater than 3.5 mm; the diameter of the core rod is not less than 1.4 mm but not greater than 2.6 mm; and $D2/D1 \leqq 0.50$, where D1 is the diameter of the core rod and D2 is the diameter of a spark discharge gap portion of the chip (hereinafter simply referred to as the "diameter of the chip").

Since the distance between the chip and the copper core having high thermal conductivity is not greater than 3.5 mm, the temperature of the chip decreases through good heat conduction to the copper core. Although the definite reason is unknown, employment of a D2/D1 ratio of not greater than 0.5 yields the effect of suppressing drastic, unusual consumption of the chip and excessive heating of the core rod.

Employment of the above-mentioned iridium-based alloy, not pure iridium, as material for the chip yields the effect of suppressing volatilization of iridium at high temperature, which would otherwise occur in the form of oxidation, thereby suppressing unusual consumption of the chip. Especially, unusual consumption of the chip easily occurs when the content of platinum, rhodium, rhenium and/or palladium is not less than 25 wt. % but less than 50 wt. %. In this case the effect obtained through employment of the above-described dimensions becomes remarkable.

Preferably, the diameter D1 of the core rod is not greater than 2.3 mm, and the D2/D1 ratio is not greater than 0.45.

In this case, even when the diameter D1 of the core rod is not greater than 2.3 mm, unusual consumption of the chip can be suppressed.

Preferably, the diameter D1 of the core rod is less than 2.0 mm, and the D2/D1 ratio is not greater than 0.40.

In this case, even when the diameter D1 of the core rod is less than 2.0 mm, unusual consumption of the chip can be suppressed. As the diameter D1 of the core rod decreases, the D2/D1 ratio that yields the effect of suppressing unusual consumption of the chip decreases. This is conceivably because, as the diameter D1 of the core rod decreases, heat conduction from the chip to the core rod deteriorates.

Preferably, the diameter D2 of the chip and an axially exposed length L of the chip satisfy the relationship "$L \leqq 1.2 \times D2$."

Employment of the above dimensional relationship yields the effect of suppressing biased consumption of the chip. Conceivably, when the axial length of the chip becomes too long, heat conduction from the chip to the core rod deteriorates. As a result, the temperature of a portion of the chip increases to an unusually high level, thereby causing oxidation and evaporation of iridium, with resultant biased consumption of the chip. Therefore, employment of the above restriction on the axially exposed length L of the chip yields the effect of suppressing biased consumption of the chip.

The spark plug of the invention is equipped with the chip of the iridium-based alloy and imposes the predetermined restriction on the relationship between the chip diameter and the core rod diameter, thereby preventing unusual consumption or biased consumption of the chip and suppressing excessive heating of the core rod. Thus, the spark plug of the invention facilitates the feature of iridium that the melting point is high and provides high performance and long life.

BRIEF DESCRIPTION OF THE DRAWINGS

Various other objects, features and many of the attendant advantages of the present invention will be readily appreciated as the same becomes better understood by reference to the following detailed description of the preferred embodiment when considered in connection with the accompanying drawings, in which.

DESCRIPTION OF THE PREFERRED EMBODIMENT

An embodiment of the present invention will next be described in detail with reference to the drawings.

Figure 1:
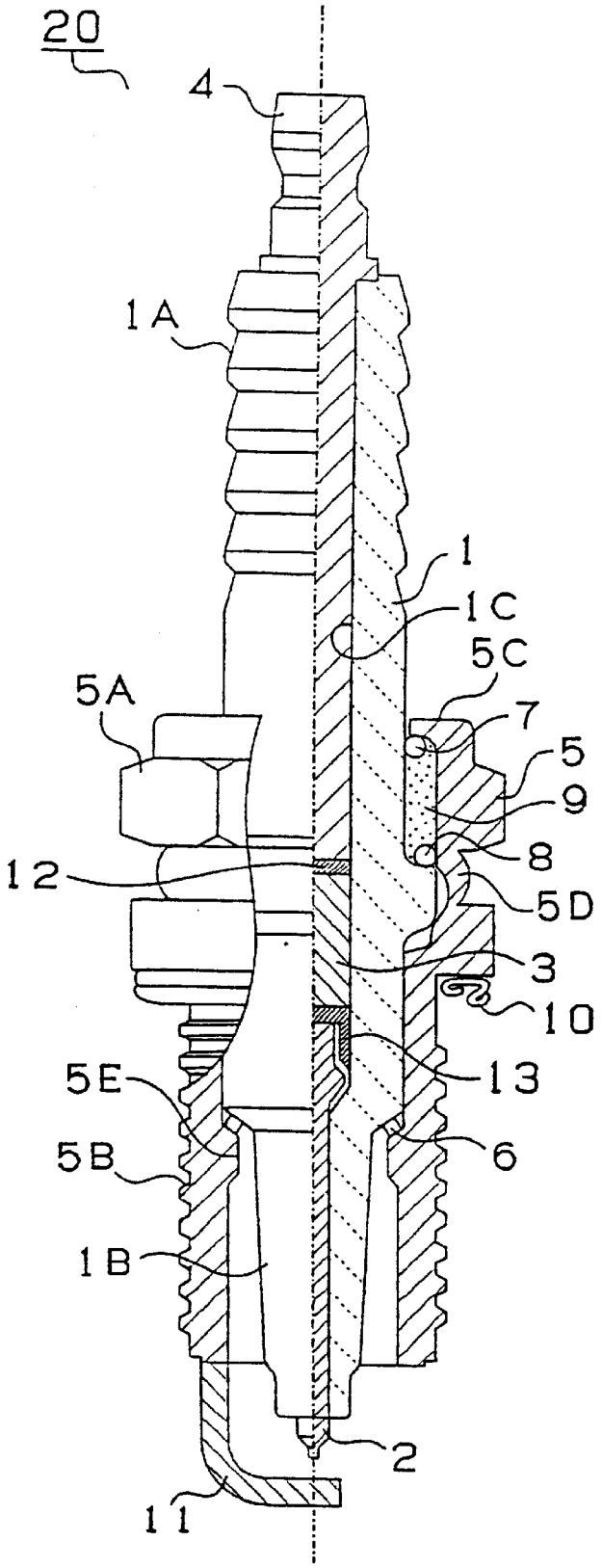
FIG. 1 is an elevational view in partial section of a spark plug according to an embodiment of the present invention.

FIG. 1 shows a spark plug 20 according to an embodiment of the present invention. An insulator 1 made of, for example, alumina has corrugations 1A formed at an upper portion in FIG. 1 and adapted to increase creeping distance and a leg portion 1B formed at a lower portion in FIG. 1 and exposed to the interior of the combustion chamber of an internal combustion engine. A center through-hole 1C is formed axially in the insulator 1. A center electrode 2 made of a nickel alloy, such as inconel, is held in the center through-hole 1C in such a manner as to project from the lower end (in FIG. 1) of the insulator 1. The center electrode 2 is not simply made of inconel, but includes a copper core extending axially within an inconel body in order to improve thermal conductivity. FIG. 1 does not show the copper core to avoid complication of the drawing. The center electrode 2 is electrically connected to a terminal 4 located at the top of the spark plug 20 in FIG. 1, via conductive glass seal layers 12 and 13 and a resistor 3 provided within the center through-hole 1C. A high tension cable (not illustrated) is connected to the terminal 4 for application of high voltage to the terminal 4. The insulator 1 rests in a metallic shell 5.

The metallic shell 5 is made of low-carbon steel and includes a hexagonal portion 5A adapted to engage a spark plug wrench and a screw portion 5B to be screwed into a cylinder head. The metallic shell 5 is caulked to the insulator 1 by means of a caulking portion 5C, whereby the metallic shell 5 and the insulator 1 are integrated into a single unit. A curved portion 5D is adapted to absorb axial deformation of the metallic shell 5 that accompanies caulking. In order to complement sealing effected by caulking, a sheet packing 6 is disposed between an inner, circumferential stepped portion 5E of the metallic shell 5 and the insulator 1 so as to provide perfect sealing between the leg portion 1B exposed to the interior of the combustion chamber and an upper portion (in FIG. 1) of the insulator 1. Wire-like sealing members 7 and 8 are disposed between the caulking portion 5C and the insulator 1 and talc powder 9 is filled between the sealing members 7 and 8 so as to establish elastic sealing, thereby fixedly and completely engaging the metallic shell 5 and the insulator 1 together. Of course, a spark plug not having the talc 9 is also acceptable. A gasket 10 is disposed at an upper end (in FIG. 1) of the screw portion 5B. A ground electrode 11 of nickel alloy is welded to a lower end (in FIG. 1) of the metallic shell 5. The ground electrode 11 is bent at a right angle such that a plane surface of a tip end portion thereof faces a tip end of the center electrode 2.

Figure 2:
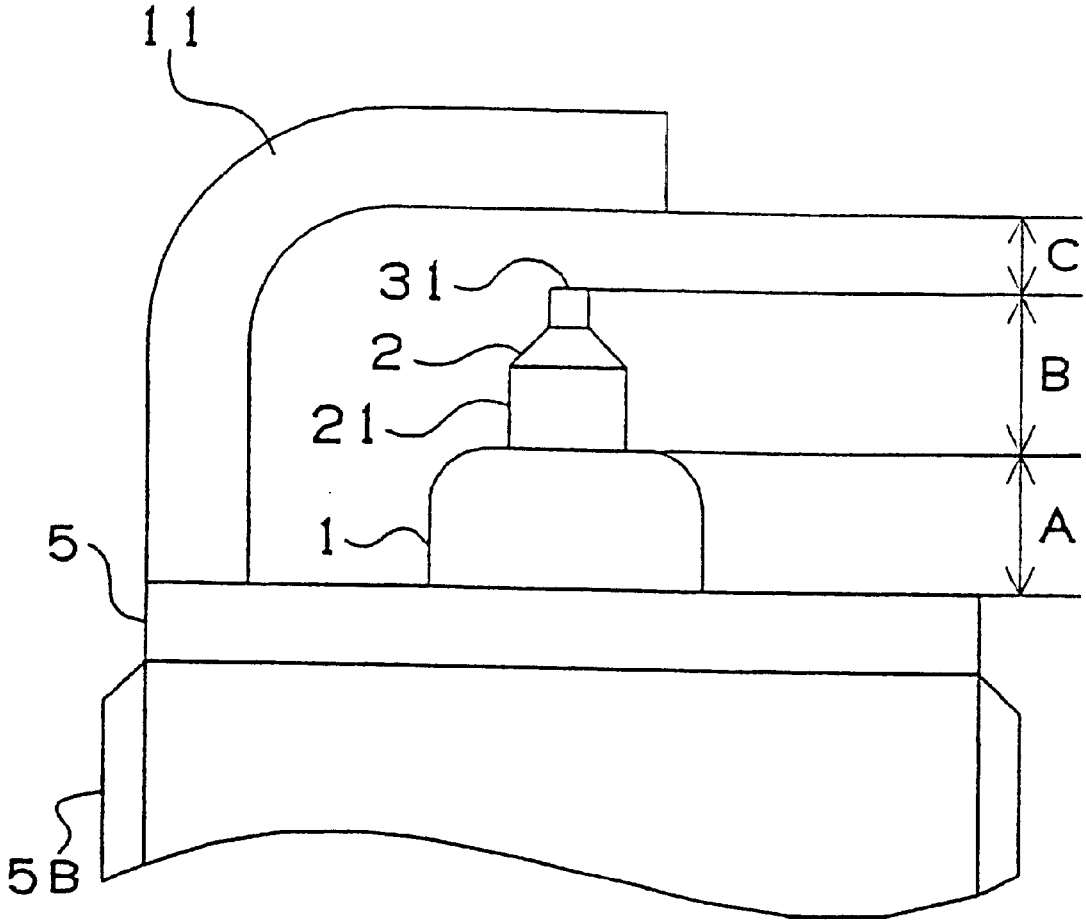
FIG. 2 is an enlarged, fragmentary, elevational view of a tip end portion of the spark plug of FIG. 1.

FIG. 2 shows an enlarged view of a tip end portion of the spark plug 20. In contrast to FIG. 1, the spark plug 20 is oriented such that the ground electrode 11 faces upward. The insulator 1 is slightly projected from an end face of the metallic shell 5. The center electrode 2 is projected from the insulator 1. The center electrode 2 includes a core rod 21 and a chip 31 bonded to a tip end of the core rod 21. The core rod 21 is made mainly of inconel, which is a nickel alloy, while the chip 31 is made of an iridium-based alloy. A root portion of the core rod 21 is embedded in the insulator 1 and a portion of the core rod 21 projecting from the insulator 1 is tapered such that the diameter reduces upward in FIG. 2. A length A of a portion of the insulator 1 projecting from the metallic shell 5 is 1.5 mm, a length B of a portion of the center electrode 2 projecting from the insulator 1 is 2.0 mm, and a gap C between the center electrode 2 and the ground electrode 11 is 1.05 mm.

Figure 3:
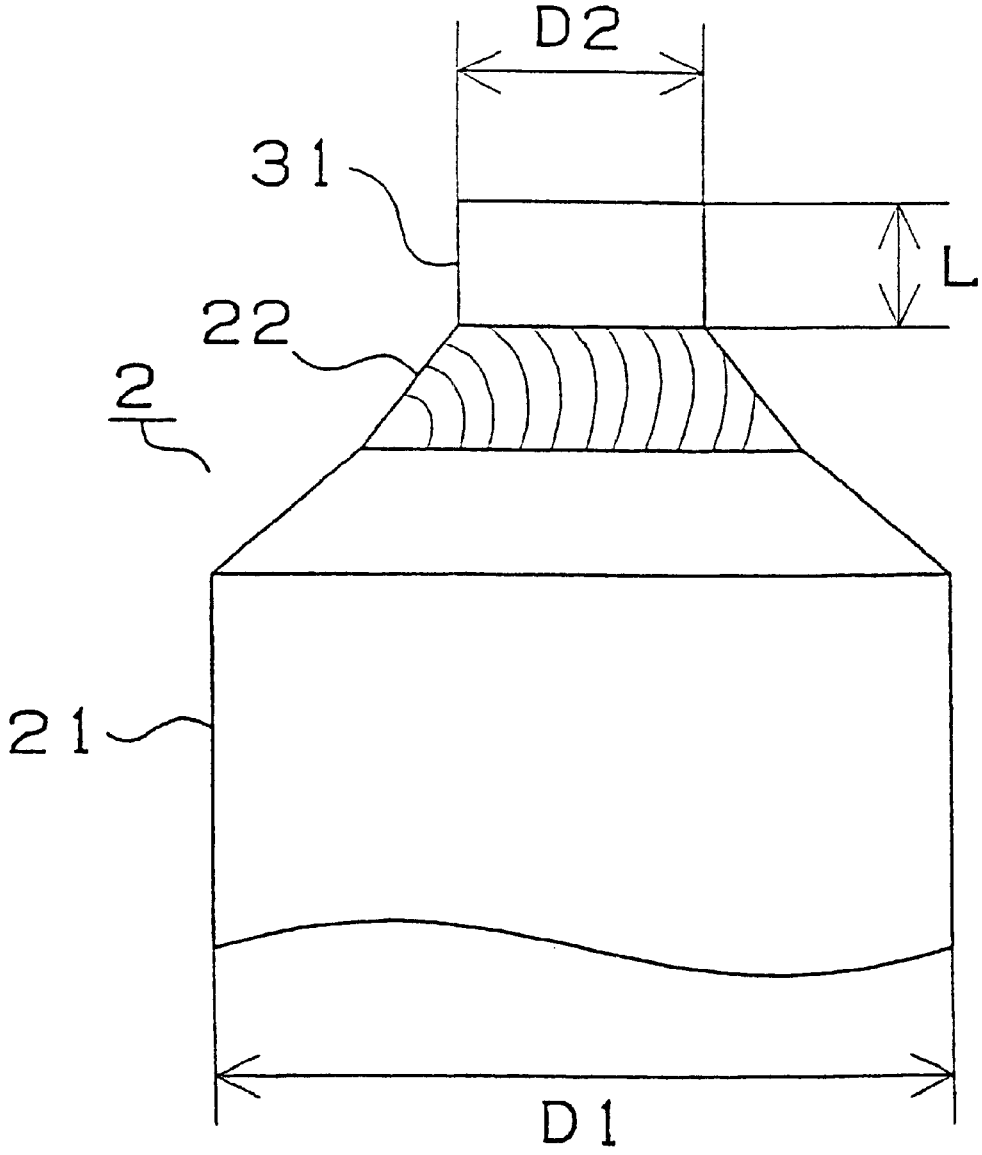
FIG. 3 is a greatly enlarged, fragmentary, elevational view showing a center electrode.
Figure 4B:
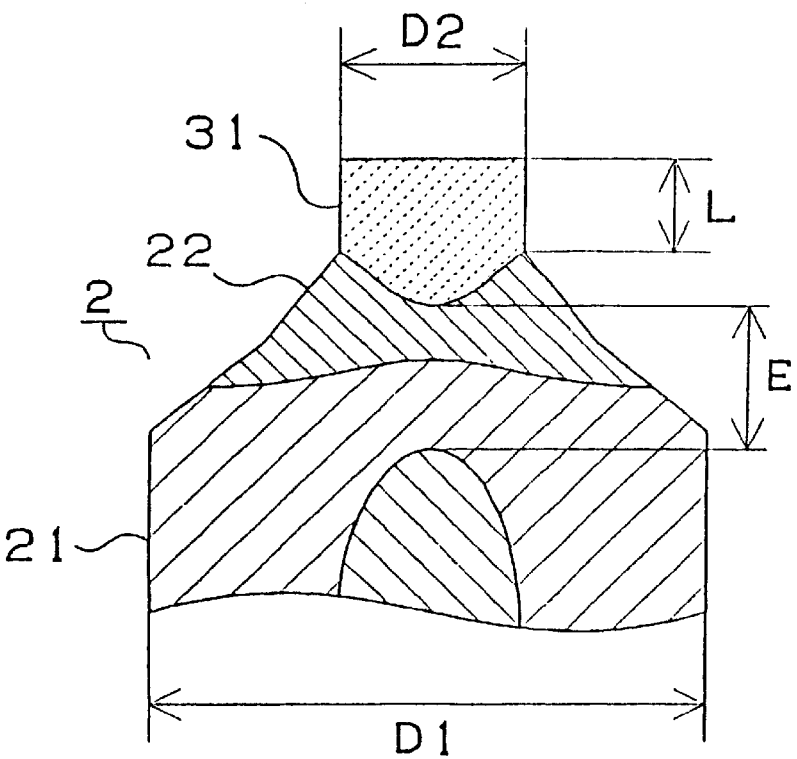
FIGS. 4A and 4B are greatly enlarged, fragmentary, sectional views of a tip end portion of the center electrode.
Figure 4A:
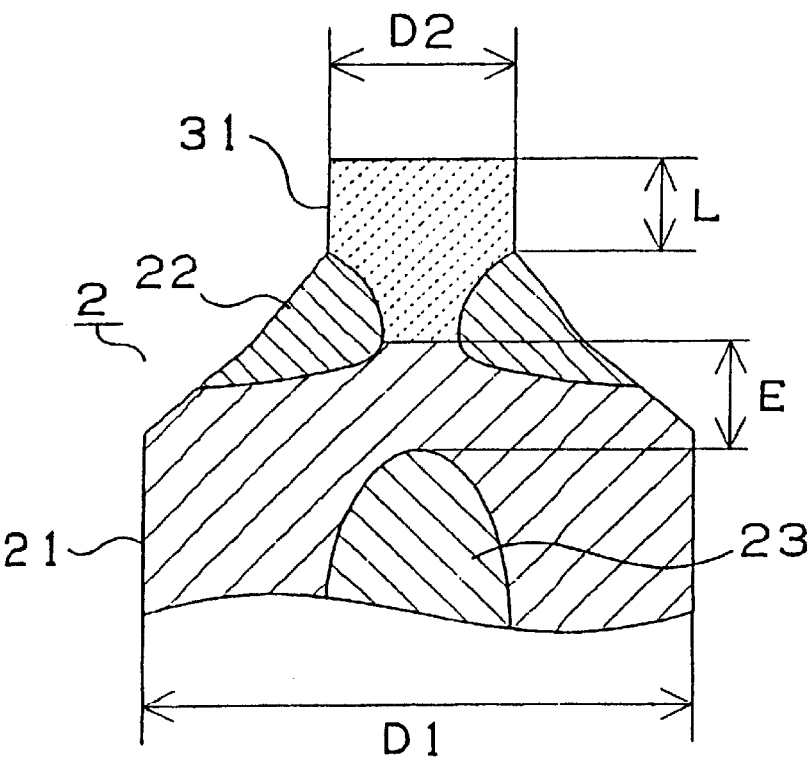

FIG. 3 shows a tip end portion of the center electrode 2. FIGS. 4A and 4B are sectional views showing the end portion of the center electrode 2. The chip 31 is made of an Ir-25Pt alloy, which is prepared through addition of 25 wt. % platinum to iridium. The chip 31 is bonded to the core rod 21 through laser welding. Accordingly, a weld bead 22 is formed in an interface portion between the chip 31 and the core rod 21. The weld bead 22 exhibits an alloy state produced through fusion of the Ir-25Pt alloy and inconel. The weld bead 22 involves the following two types. FIG. 4A shows one type; specifically, the weld bead 22 does not reach the axis of the chip 31 and the core rod 21, so that a central portion of the chip 31 and that of the core rod 21 are in direct contact with each other. FIG. 4B shows the other type; specifically, the weld bead 22 reaches the axis of the chip 31 and the core rod 21, so that the weld bead 22 lies between the chip 31 and the core rod 21. Herein, D1 represents the diameter of the core rod 21, D2 represents the diameter of the chip 31, and L represents the axially exposed length of the chip 31.

A copper core 23 is embedded in a central portion of the core rod 21. Since copper has high thermal conductivity, the copper core 23 improves heat conduction through the core rod 21. A distance E between the chip 31 and a tip end of the copper core 23 is 3.0 mm. As in the case of FIG. 4B where the weld bead 22 lies between the chip 31 and the core rod 21, the distance E is measured across the weld bead 22 and between the chip 31 and the copper core 23.

EXAMPLES

The present invention will next be described in detail by way of examples, which should not be construed as limiting the invention.

Various kinds of spark plugs were prepared while the diameter D1 of the core rod 21, the diameter D2 of the chip 31, and the axially exposed length L of the chip 31 were varied. These spark plugs were mounted on an actual engine and underwent a durability test. First, the test results of spark plugs having a core rod diameter D1 of 1.7 mm will be reported. The reason why a core rod diameter D1 of 1.7 mm is selected is that regular engine operation fails to impose severe load on a spark plug having a standard core rod diameter of 2.0 mm or greater. The spark plugs having a core rod 21 thinner than a standard core rod were intentionally selected to check for durability under severe operating conditions where the temperature of a tip end portion of a spark plug reaches 700° to 900° C.

Figure 5B:
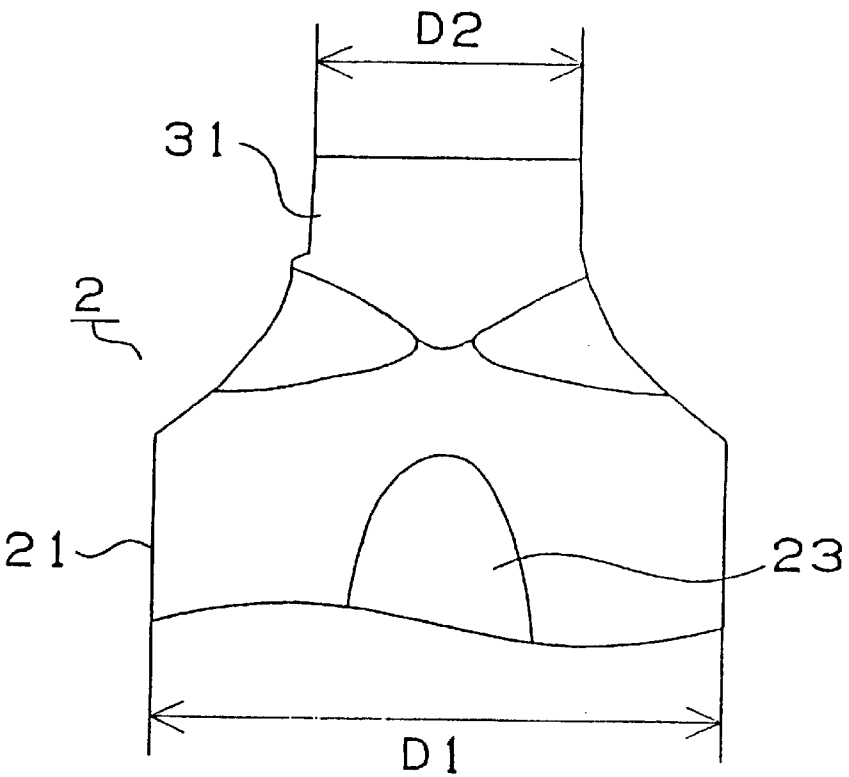
FIG. 5B is a greatly enlarged, fragmentary, sectional view of a tip end portion of the center electrode having a chip of a relatively large diameter as observed before subjection to a durability test and prepared through tracing from a corresponding original photograph.
Figure 5A:
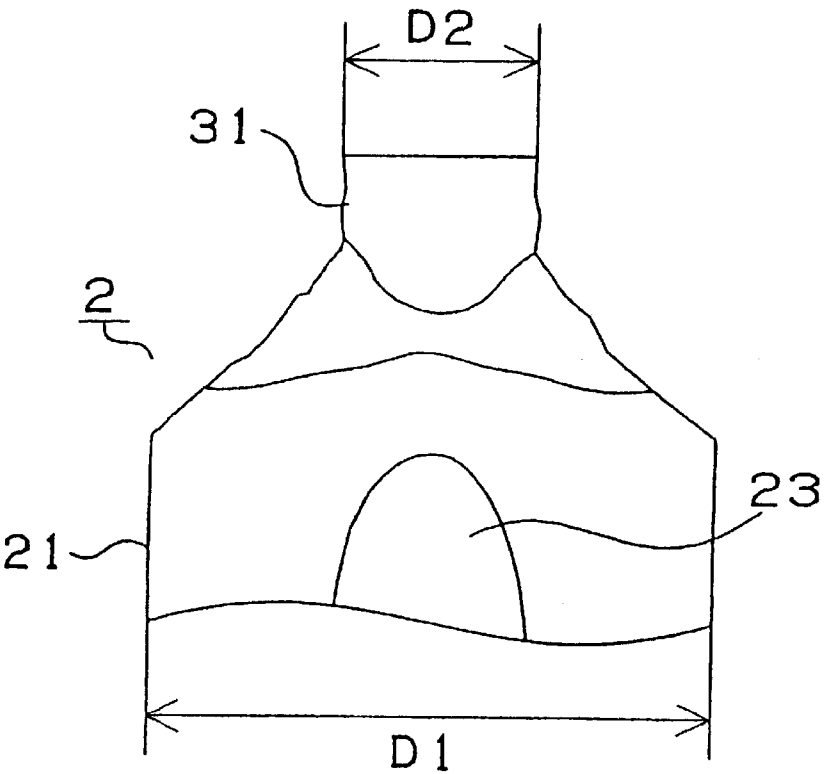
FIG. 5A is a greatly enlarged, fragmentary, sectional view of a tip end portion of the center electrode having a chip of a relatively small diameter as observed before subjection to a test and prepared through tracing from a corresponding original photograph.

FIGS. 5A and 5B are enlarged, sectional views showing the center electrodes 2 as observed before subjection to the durability test and prepared through tracing from the corresponding original photographs. In FIGS. 5A and 5B, the core rod diameter D1 is 1.7 mm. The center electrode 2 of FIG. 5A has as small a chip diameter D2 as 0.7 mm and a D2/D1 ratio of 0.4. The center electrode 2 of FIG. 5B has as large a chip diameter D2 as 1.2 mm and a D2/D1 ratio of 0.7.

Figure 6:
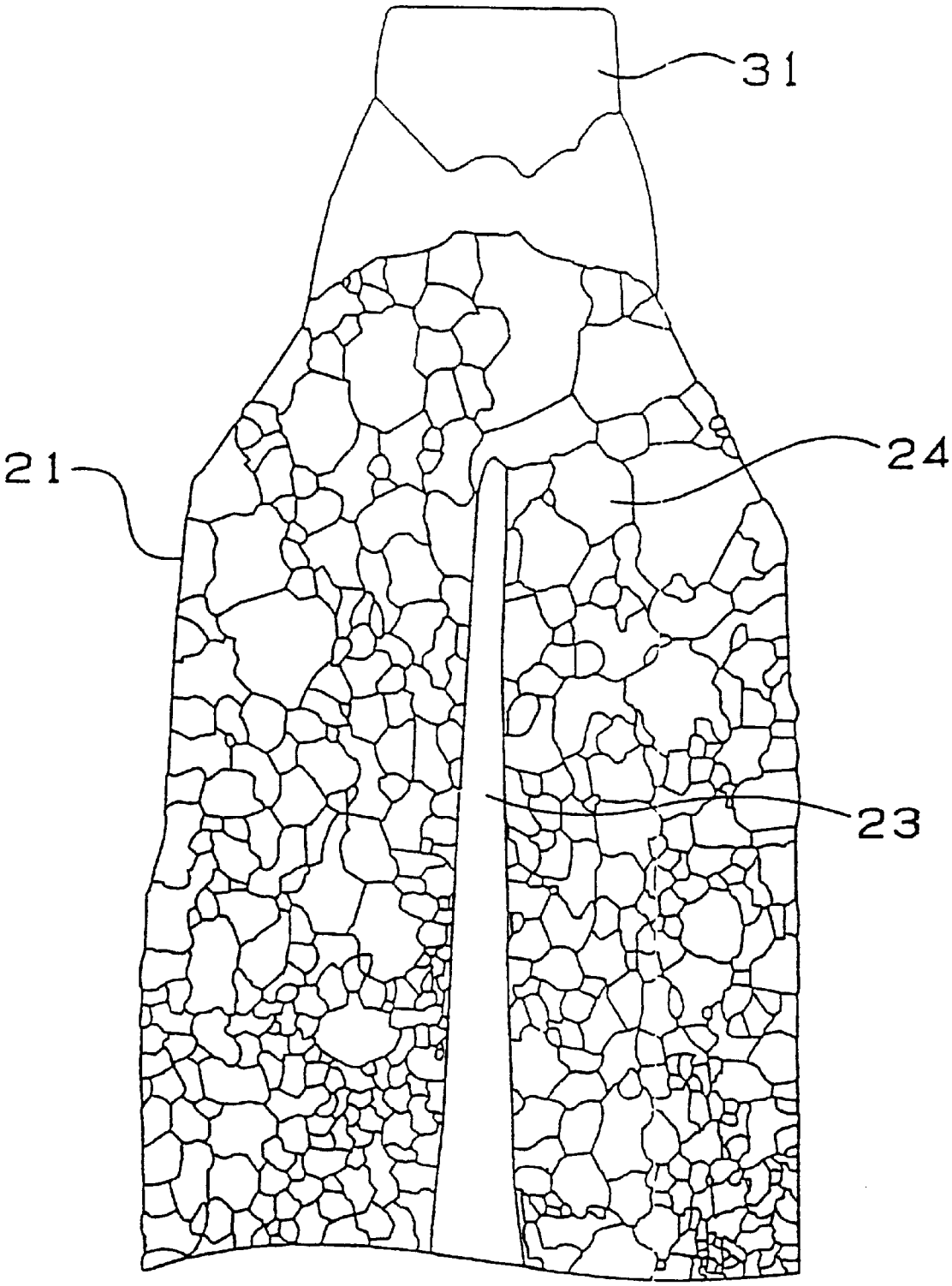
FIG. 6 is a greatly enlarged, fragmentary, sectional view of the center electrode having a chip of a relatively small diameter as observed after subjection to a durability test and prepared through tracing from a corresponding original photograph.
Figure 7:
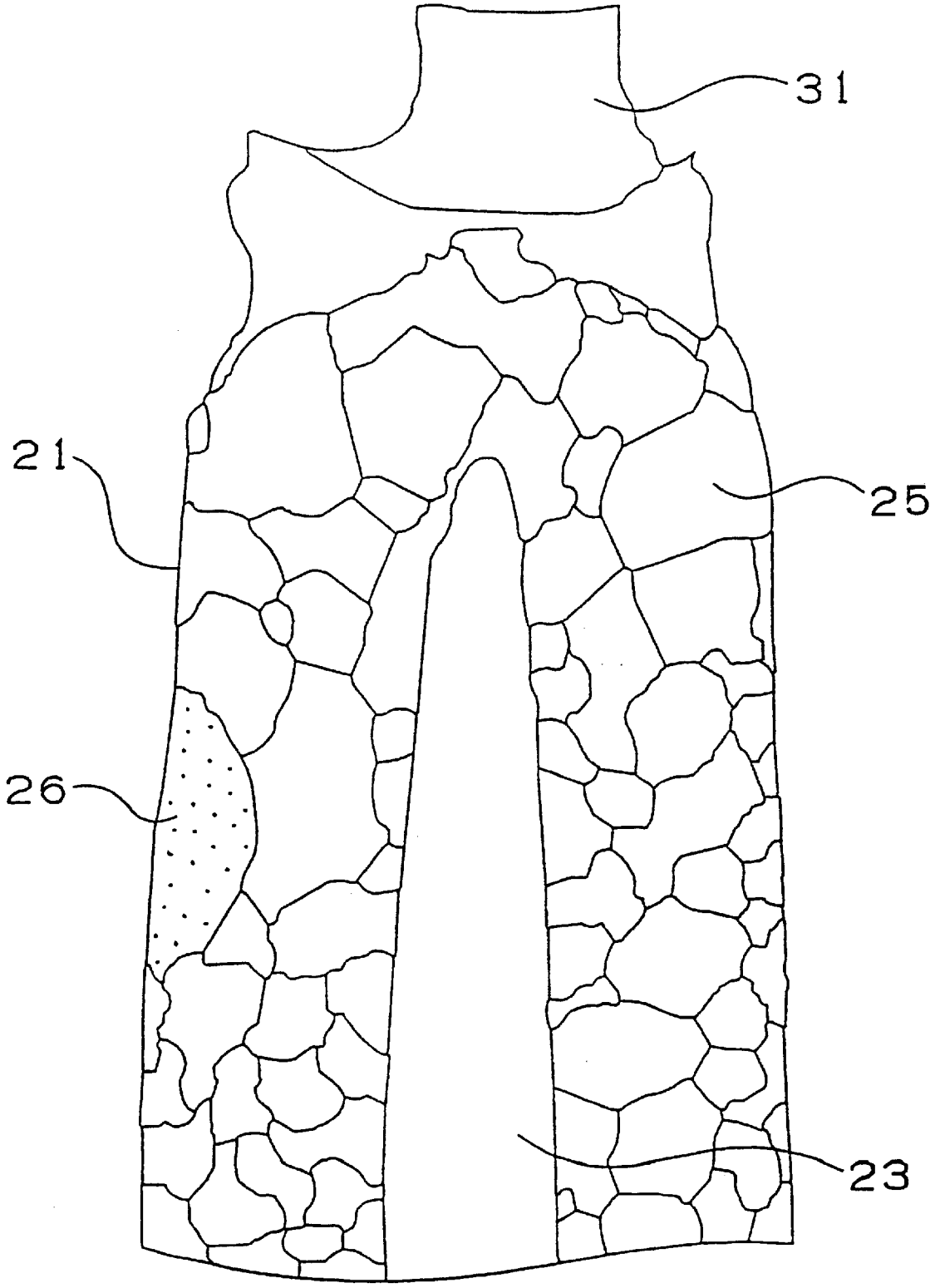
FIG. 7 is a greatly enlarged, fragmentary, sectional view of the center electrode having a chip of a relatively large diameter as observed after subjection to a durability test and prepared through tracing from a corresponding original photograph.

FIGS. 6 and 7 are enlarged, sectional views showing the center electrodes 2 as observed after subjection to the durability test on an actual engine and prepared through tracing from the corresponding original photographs. The spark plugs of FIGS. 6 and 7 belong to the same lot as that to which the spark plugs of FIGS. 5A and 5B belong. The center electrode of FIG. 6 corresponds to that of FIG. 5A. Specifically, the core rod diameter D1 is 1.7 mm, the chip diameter D2 is 0.7 mm, and thus the D2/D1 ratio is 0.4. The center electrode of FIG. 7 corresponds to that of FIG. 5B. Specifically, the core rod diameter D1 is 1.7 mm, the chip diameter D2 is 1.2 mm, and thus the D2/D1 ratio is 0.7. The durability test was conducted through use of a 6 cylinder, 2 liter DOHC engine under the following conditions: WOT (wide open throttle), 5600 rpm, and 40 hours. This test is equivalent to travel over a distance of about 7200 km at 180 km/h.

As seen through comparison with the center electrode 2 of FIG. 5A, the center electrode of FIG. 6, having the small diameter chip 31, shows little consumption of the chip 31. Also, the growth of inconel crystal grains 24 of the core rod 21 is small, indicating that heat to which the core rod 21 was subjected was of low temperature. By contrast, as seen through comparison with the center electrode 2 of FIG. 5B, the center electrode of FIG. 7, having the large diameter chip 31, shows an unusually significant consumption of the chip 31. Also, the growth of inconel crystal grains 25 of the core rod 21 is large. Further, a fusion mark 26 indicating the initiation of fusion of inconel is observed at a left hand side portion of the core rod 21. These phenomena indicate that heat to which the core rod 21 was subjected was of very high temperature. These test results imply that a spark plug having the chip 31 of an iridium-based alloy needs to render the chip diameter D2 considerably small as compared to the core rod diameter D1.

Figure 8B:
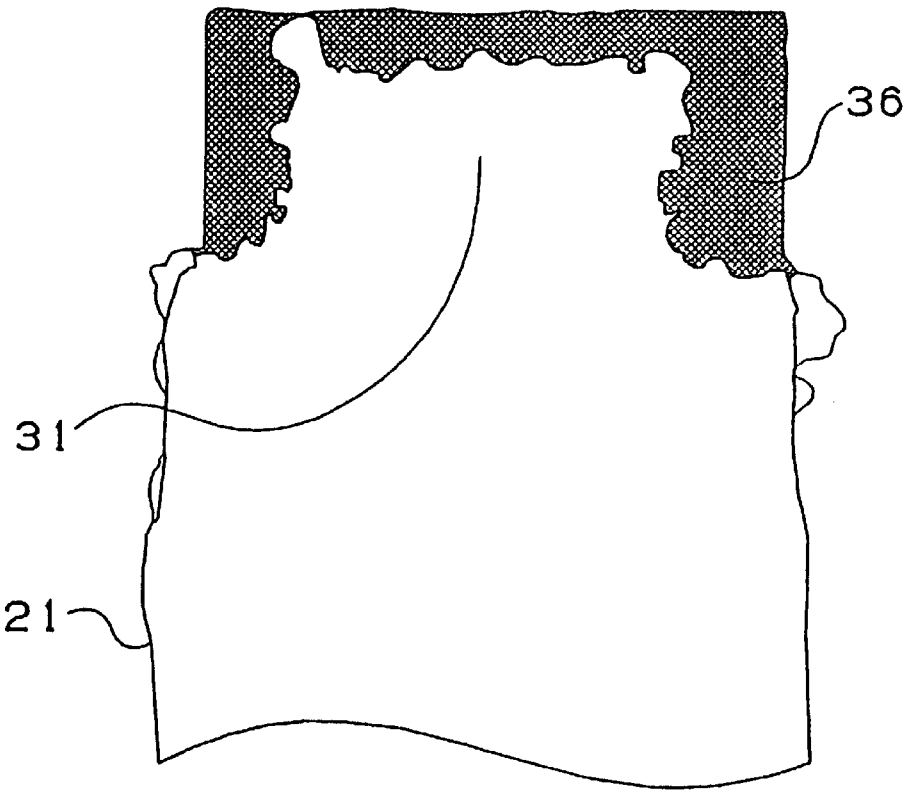
FIG. 8B is a greatly enlarged, fragmentary, sectional view showing chip consumption in a spark plug having a chip of a relatively large diameter and prepared through tracing from a corresponding original photograph.
Figure 8A:
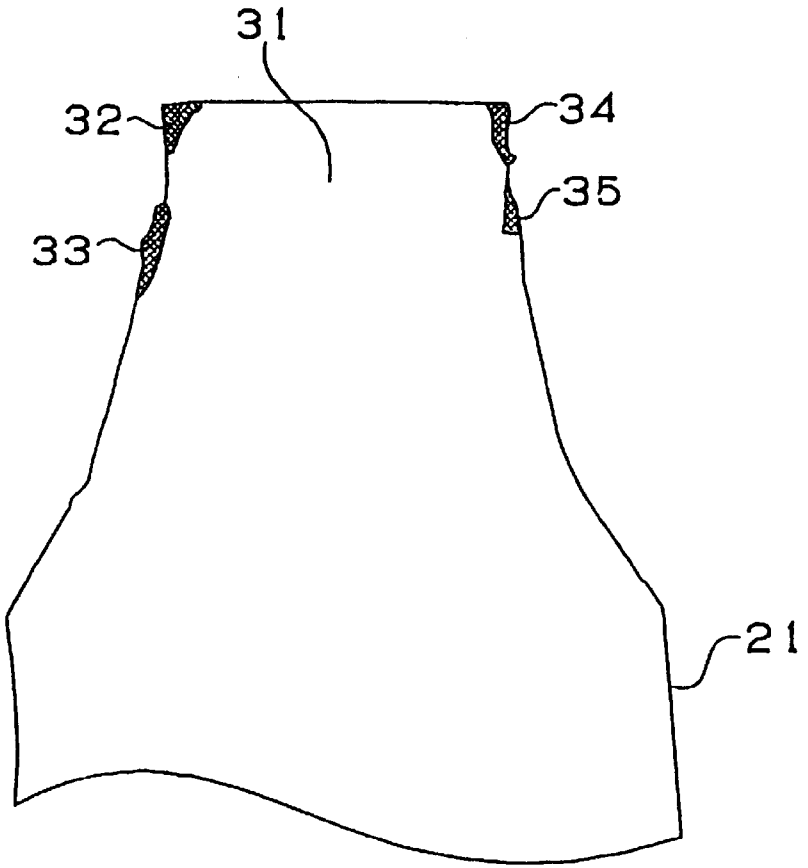
FIG. 8A is a greatly enlarged, fragmentary, sectional view showing chip consumption in a spark plug having a chip of a relatively small diameter and prepared through tracing from a corresponding original photograph.

In order to evaluate the degree of consumption of the chip 31, spark plugs manufactured in the same lot were subjected to the durability test by use of the actual engine. The sectional area of the chip 31 as measured before the test was compared to that as measured after the test, thereby obtaining the sectional area of a lost portion for evaluation use. In FIGS. 8A and 8B, hatched portions have been lost during the durability test. The center electrode of FIG. 8A has a core rod diameter D1 of 1.7 mm, a chip diameter D2 of 0.7 mm, and thus a D2/D1 ratio of 0.4. The center electrode of FIG. 8B has a core rod diameter D1 of 1.7 mm, a chip diameter D2 of 1.2 mm, and thus a D2/D1 ratio of 0.7. The center electrode of FIG. 8A (D2/D1=0.4) shows slightly lost portions 32, 33, 34, and 35 in a peripheral region of the chip 31; however, the total sectional area of the lost portions is small. By contrast, the center electrode of FIG. 8B (D2/D1=0.7) shows a large lost portion 36 extending over the entire periphery of the chip 31 and the sectional area of the lost portion 36 is large.

The present inventors conducted a test for evaluating the durability of spark plugs by use of the actual engine while the core rod diameter D1 and the chip diameter D2 were varied in order to evaluate consumption of the chip 31 based on the above-mentioned sectional area of a lost portion. The inventors also found that the test data became more informative when arranged in relation to the D2/D1 ratio. Table 1 shows the thus-arranged test data.

TABLE 1

Chip consumption vs. Chip diameter D2

| Core rod dia. D1 | D2/D1 | | | | | | | | |
|---|---|---|---|---|---|---|---|---|---|
| (mm) | 0.7 | 0.6 | 0.5 | 0.45 | 0.4 | 0.35 | 0.3 | 0.25 | 0.2 |
| 2.6 | F | F | B | A | A | A | A | A | A |
| 2.5 | F | F | B | A | A | A | A | A | A |
| 2.4 | F | F | B | A | A | A | A | A | A |
| 2.3 | F | F | C | B | A | A | A | A | A |
| 2.2 | F | F | C | B | A | A | A | A | A |
| 2.1 | F | F | C | B | A | A | A | A | A |
| 2.0 | F | F | C | B | A | A | A | A | A |
| 1.9 | F | F | C | C | B | A | A | A | A |
| 1.8 | F | F | C | C | B | A | A | A | A |
| 1.7 | F | F | C | C | B | A | A | A | A |
| 1.6 | F | F | C | C | B | A | A | A | A |
| 1.5 | F | F | C | C | B | A | A | A | A |
| 1.4 | F | F | C | C | B | A | A | A | A |

As shown in Table 1, the core diameter D1 was varied from 2.6 mm to 1.4 mm at 0.1 mm intervals. The D2/D1 ratio was varied from 0.7 to 0.2. In Table 1, a symbol "F" indicates that not less than 20% of the sectional area of the chip 31 has been lost; a symbol "C" indicates that 10–20% of the sectional area has been lost; a symbol "B" indicates that 3–10% of the sectional area has been lost; and a symbol "A" indicates that less than 3% of the sectional area has been lost.

As seen from Table 1, as the D2/D1 ratio reduces, the number of symbol A's increases, indicating that the consumption of the chips 31 reduces. In a center electrode profile having a core rod diameter D1 of 2.6 mm to 2.4 mm and a D2/D1 ratio of not greater than 0.50, the test chips 31 are evaluated as "B" or "A," indicating that the consumption of the chip 31 is less than 10%, which is an acceptable level for actual use. These test results support the effect of the present invention. Similarly, in a center electrode profile having a core rod diameter D1 of 2.3 mm to 2.0 mm and a D2/D1 ratio of not greater than 0.45, the test chips 31 are evaluated as "B" or "A," indicating that the consumption of the chips 31 is less than 10%, which is an acceptable level for actual use.

These test results support the effect obtained by the limitation of the diameter D1 of the core rod being not greater than 2.3 mm, and the D2/D1 ratio being not greater than 0.45. Further, in a center electrode profile having a core rod diameter D1 of 1.9 mm to 1.4 mm and a D2/D1 ratio of not greater than 0.40, the test chips 31 are evaluated as "B" or "A," indicating that the consumption of the chips 31 is less than 10%, which is an acceptable level for actual use. These test results support the effect obtained by the limitation of the diameter D1 of the core rod being not greater than 2.0 mm, and the D2/D1 ratio being not greater than 0.40.

In a center electrode profile having a core rod diameter D1 of 1.4 mm and a D2/D1 ratio of 0.2, the consumption of the chip 31 is less than 3%, but the chip diameter D2 becomes 0.28 mm, which is smaller than 0.3 mm. At a chip diameter D2 of less than 0.3 mm, the spark plug life decreases to about 40,000 km, indicating low cost performance. Accordingly, the chip diameter D2 is preferably not less than 0.3 mm, which is not directly related to the gist of the invention, though.

The above-described durability test on an actual engine was carried out in an attempt to examine the relationship between chip consumption and the ratio between the chip diameter D2 and the core rod diameter D1, or D2/D1. Next will be described a durability test that was carried out by use of an actual engine in an attempt to examine the relationship between chip consumption and the axially exposed length L of the chip 31.

Figure 9B:
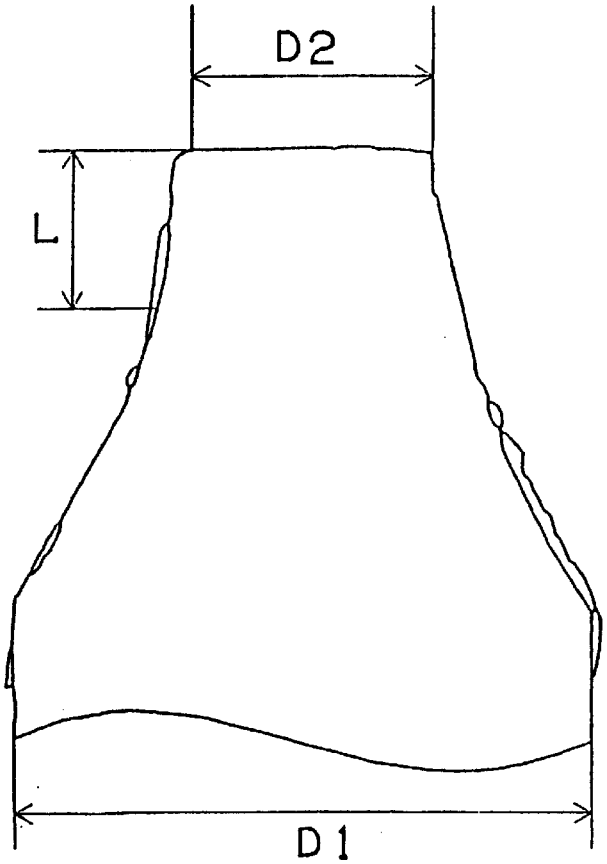
FIG. 9B is a greatly enlarged, fragmentary, sectional view showing chip consumption in a spark plug having a relatively short exposed chip length.
Figure 9A:
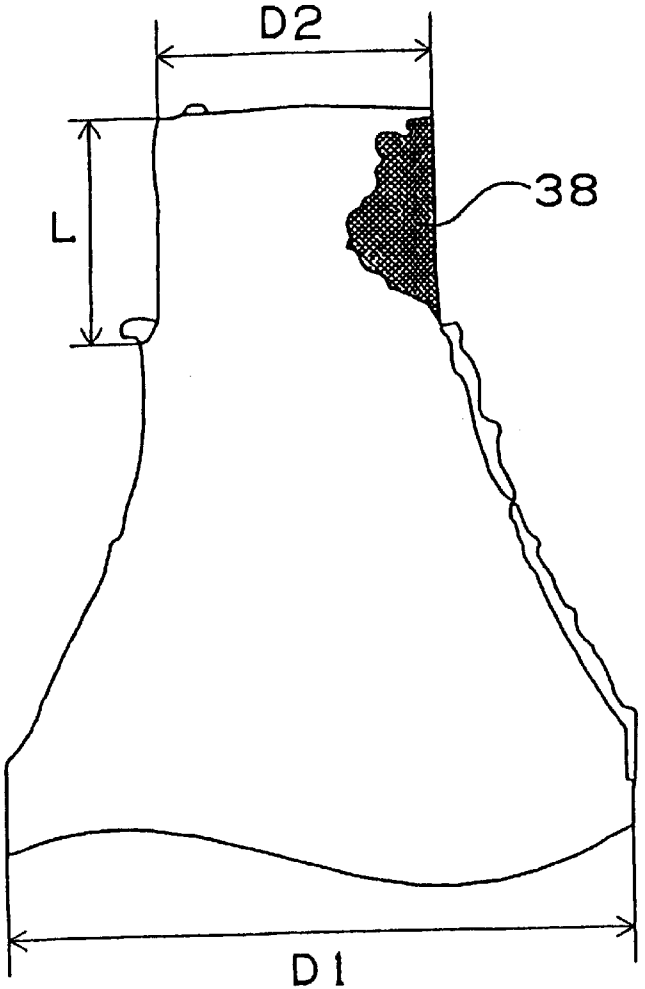
FIG. 9A is a greatly enlarged, fragmentary, sectional view showing chip consumption in a spark plug having a relatively long exposed chip length.

FIGS. 9A and 9B are enlarged, sectional views showing the center electrodes 2 of different exposed chip lengths L of the spark plugs having undergone the durability test and prepared through tracing from the corresponding original photographs. A hatched portion 38 has been lost during the durability test. The center electrodes 2 of FIGS. 9A and 9B have a core rod diameter D1 of 1.7 mm, a chip diameter D2 of 0.7 mm and thus a D2/D1 ratio of 0.4. The center electrode 2 of FIG. 9A has an axially exposed chip length L of 0.88 mm and thus an L/D2 ratio of 1.3. The center electrode 2 of FIG. 9B has an axially exposed chip length L of 0.70 mm and thus an L/D2 ratio of 1.0. The durability test was conducted through use of a 6 cylinder, 2.5 liter DOHC engine under the following conditions: WOT (wide open throttle), 5600 rpm and 35 hours.

The center electrode 2 of FIG. 9A—in which the axially exposed chip length L is relatively long in relation to the chip diameter D2—shows the lost portion 38 caused by significant biased consumption at a side portion of the chip 31. By contrast, the center electrode 2 of FIG. 9B—in which the axially exposed chip length L is relatively short in relation to the chip diameter D2—shows almost no chip consumption. In order to examine the relationship between chip consumption and the axially exposed chip length L, spark plugs of different exposed chip lengths L were subjected to a durability test by use of an actual engine. The spark plugs have a core rod diameter D1 of 1.7 mm, a chip diameter D2 of 0.7 mm and thus a D2/D1 ratio of 0.4. As in the case of the aforementioned durability test, the spark plugs having a small core rod diameter D1 of 1.7 mm were used in order to evaluate durability under severe operating conditions where the temperature of a tip end portion of a spark plug reaches 700° to 900° C. The ratio between the axially exposed chip length L and the chip diameter D2, or L/D2, was employed in order to examine the relationship between the axially exposed chip length L and chip consumption. The L/D2 ratio was varied from 1.0 to 1.4 in the durability test. The test results are shown in Table 2.

TABLE 2

Chip consumption vs. Axially exposed chip length L

| Core rod dia. D1 | L/D2 | | | | |
|---|---|---|---|---|---|
| (mm) | 1.4 | 1.3 | 1.2 | 1.1 | 1.0 |
| 1.7 | F | F | A | A | A |

Evaluation symbols appearing in Table 2 are similar to those appearing in Table 1. The symbol "F" indicates that not less than 20% of the sectional area of the chip 31 has been lost. The symbol "A" indicates that less than 3% of the sectional area has been lost. In this durability test, chip consumption as evaluated by the symbol "B" or "C" has not been observed. As seen from Table 2, at an L/D2 ratio of not greater than 1.2, chip consumption is acceptably small. However, at an L/D2 ratio of not less than 1.3, chip consumption increases drastically. Accordingly, the L/D2 ratio is preferably not greater than 1.2. These test results support the effect obtained by the limitation that the diameter D2 of the chip and the axially exposed length L of the chip satisfy a relationship "$L \leqq 1.2 \times D2$."

The reason why significant, unusual or biased consumption as shown in FIGS. 8B and 9A occurs is not definite. However, the following mechanism is conceivably responsible. When the D2/D1 ratio or the L/D2 ratio assumes a large value, heat conduction from the chip 31 to the core rod 21 is impaired, causing a portion of the chip 31 to be heated excessively. As a result, iridium is oxidized into iridium oxide, which directly volatilizes at high temperature. Especially, when platinum, rhodium, rhenium and/or palladium is contained in an amount of 25 to 50 wt. %, heat conduction from the chip to the core rod deteriorates. In this case, the temperature of the chip increases and consumption of the chip due to spark discharge increases due to a decreased melting point of the chip, so that unusual consumption may increase with increasing speed.

The above embodiment is described while mentioning the chip 31 of the Ir-25Pt alloy. However, the chip 31 may be made of an Ir-30Rh alloy, which is prepared through addition of 30 wt. % rhodium to iridium or an Ir-40Rh alloy which is prepared through addition of 40 wt. % rhodium to iridium. The chip 31 of the Ir-30Rh alloy also showed a consumption tendency as did the chip 31 of the Ir-25Pt alloy.

Obviously, numerous modifications and variations of the present invention are possible in light of the above teachings. It is therefore to be understood that within the scope of the appended claims, the present invention may be practiced otherwise than as specifically described herein.

What is claimed is:

1. A spark plug, comprising:

an insulator having a center through-hole;

a center electrode held in the center through-hold;

a metallic shell for holding said insulator; and a ground electrode electrically connected to said metallic shell, wherein said center electrode comprises a core rod and a chip formed of a member resistant to spark consumption and fixed to a tip end of said core rod, said chip defining a spark discharge gap in cooperation with said ground electrode, and said core rod made of a nickel-based alloy and including a copper core embedded therein;

said chip made of an iridium-based alloy which contains one or more elements selected from among platinum, rhodium, rhenium, and palladium and which is formed through melting or iridium and the selected element(s);

a distance between said chip and a tip end of said copper core not greater than 3.5 mm;

a diameter of said core rod not less than 1.4 mm but not greater than 2.3 mm; and $D2/D1 \leqq 0.45$, where D1 is the diameter of said core rod and D2 is a diameter of a spark discharge gap portion of said chip.

2. A spark plug according to claim 1, wherein the diameter D2 of said chip and an axially exposed length L of said chip satisfy a relationship "$L \leqq 1.2 \times D2$."

3. A spark plug, comprising:

an insulator having a center through-hole;

a center electrode held in the center through-hold;

a metallic shell for holding said insulator; and a ground electrode electrically connected to said metallic shell, wherein said center electrode comprises a core rod and a chip formed of a member resistant to spark consumption and fixed to a tip end of said core rod, said chip defining a spark discharge gap in cooperation with said ground electrode, and said core rod made of a nickel-based alloy and including a copper core embedded therein;

said chip made of an iridium-based alloy which contains one or more elements selected from among platinum, rhodium, rhenium, and palladium and which is formed through melting or iridium and the selected element(s);

a distance between said chip and a tip end of said copper core not greater than 3.5 mm;

a diameter of said core rod not less than 1.4 mm but not greater than 2.0 mm; and $D2/D1 \leqq 0.40$, where D1 is the diameter of said core rod and D2 is a diameter of a spark discharge gap portion of said chip.

4. A spark plug according to claim 3, wherein the diameter D2 of said chip and an axially exposed length L of said chip satisfy a relationship "$L \leqq 1.2 \times D2$."

* * * * *